US005235344A

United States Patent [19]

Shinkawa et al.

[11] Patent Number: 5,235,344

[45] Date of Patent: Aug. 10, 1993

[54] DRIVE CONTROL APPARATUS FOR AN ELECTRICALLY-DRIVEN TYPE EXTENSIBLE/RETRACTABLE ANTENNA

[75] Inventors: Masaki Shinkawa; Kiyoshi Tetsuka; Koji Arata; Misao Kimura, all of Tokyo, Japan

[73] Assignee: Harada Industry Co., Ltd., Tokyo, Japan

[21] Appl. No.: 925,900

[22] Filed: Aug. 6, 1992

Related U.S. Application Data

[63] Continuation of Ser. No. 666,353, Mar. 8, 1991, abandoned.

[30] Foreign Application Priority Data

Mar. 16, 1990 [JP] Japan ..... 2-64410

[51] Int. Cl.[5] ..... H01Q 1/10

[52] U.S. Cl. ..... 343/903; 343/715; 318/603

[58] Field of Search ..... 343/901, 903, 715, 900; 318/467, 603, 626

[56] References Cited

U.S. PATENT DOCUMENTS

| | | | |
|---|---|---|---|
| 4,514,670 | 4/1985 | Fassel et al. | 318/467 |
| 4,591,868 | 5/1986 | Cusey et al. | 343/903 |
| 4,749,924 | 6/1988 | Watanabe et al. | 318/474 |
| 4,864,322 | 9/1989 | Yamamoto et al. | 343/903 |
| 4,990,836 | 2/1991 | Nakase et al. | 318/285 |

FOREIGN PATENT DOCUMENTS

| | | |
|---|---|---|
| 0320242 | 6/1989 | European Pat. Off. . |
| 2512791 | 10/1976 | Fed. Rep. of Germany . |
| 3425391 | 1/1986 | Fed. Rep. of Germany . |
| 2187597 | 9/1987 | United Kingdom . |
| 83/03715 | 10/1983 | World Int. Prop. O. . |

*Primary Examiner*—Rolf Hill
*Assistant Examiner*—Hoanganh Le
*Attorney, Agent, or Firm*—Frishauf, Holtz, Goodman & Woodward

[57] ABSTRACT

A drive control apparatus for an electrically-driven type extensible/retractable antenna comprises a control circuit connected to a power supply, a motor controllable by the control circuit to be rotated in a normal or a reverse direction, a multi-threaded type worm provided on an output shaft of the motor, a worm wheel engaging with the worm, a drive gear receiving a rotational force of the worm wheel to allow it to be rotatably driven, a drive rope having a rack in mesh with the drive gear and adapted to be moved in a longitudinal direction upon the rotation of the drive gear, an extensible/retractable antenna element driven by the drive rope to allow it to be extended or retracted, stopper means for mechanically stopping an extending or a retracting motion of the antenna element when the antenna element reaches an extension or a retraction limit, a shock absorber made up principally of an elastic member for alleviating an impact force by which the antenna element is stopped upon collision with the stopper means, the elastic member being placed partway on a movable system from the output shaft of the motor to impact portions colliding with the stopper means, and switching means provided in the control circuit and adapted to cut off the power supply to the motor when an elastic deformation of the shock absorber is stopped.

4 Claims, 8 Drawing Sheets

DRIVE CONTROL APPARATUS FOR AN ELECTRICALLY-DRIVEN TYPE EXTENSIBLE/RETRACTABLE ANTENNA

This application is a continuation of application Ser. No. 07/666,353, filed Mar. 8, 1991, now abandoned.

BACKGROUND OF THE INVENTION

1. Field of the Invention

The present invention relates to a drive control apparatus for an electrically-driven type extensible/retractable antenna as mounted on, for example, an automobile, etc.

2. Description of the Related Art

An electrically-driven type extensible/retractable antenna mounted on an automobile, etc., is generally so formed that, when an associated motor is rotated in a normal or a reverse direction, a telescopic antenna element is extended or retracted. The antenna element, upon being brought to an extension or retraction motion limit, is not further moved. In this case an excessive load is abruptly applied to the motor. When such a situation is continued, an excessive current continues to flow in the motor winding, causing burning. In order to avoid this, a clutch is usually interposed between the motor side and the antenna side. The clutch is of such a type that a clutch plate on a driving side (a motor side) and a clutch plate on a driven side (an antenna side) are so oppositely arranged that they are slidably moved relative to each other with a given frictional resistance. When the antenna element reaches the extension or the retraction motion limit, the driving-and driven-side clutch plates are subject to a slip motion, temporarily releasing their motor- and antenna-side coupling.

The clutch as set out above produces a louder noise upon the slip motion of its clutch plates and causes a severe friction, resulting in a drop in pressure of the clutch in a relatively short period of time. Therefore, no rotational force is transmitted from the driving-side to the driven-side, thereby a reducing reliable operation over a longer period of time.

SUMMARY OF THE INVENTION

It is accordingly the object of the present invention to provide a simpler, compact drive control apparatus for an electrically-driven type extensible/retractable antenna, which can alleviate a mechanical shock upon the completion of an antenna element's extension or retraction motion to prevent a damage to the apparatus and alleviate an abrupt increase in a load involved to prevent a burning, etc., of a motor winding, can stably transmit a drive force from a motor side to an antenna side over an extended period of time, can stably and properly interrupt a power supply, and can avoid any loud noise, etc., originating from a clutch which has been used in a conventional apparatus, and in which the antenna element can readily be operated by hand.

In order to solve the aforementioned task and achieve the aforementioned object, the following effective means is provided as a basic means according to the present invention.

According to the present invention, there is provided a drive control apparatus for an extensible/retractable antenna, comprising:

a control circuit connected to a power supply;

a motor controllable by the control circuit to be rotated in a normal or a reverse direction;

a multi-threaded type worm provided on an output shaft of the motor;

a worm wheel engaging with the worm;

a drive gear receiving a rotational force of the worm wheel to allow it to be rotatably driven;

a drive rope having a rack in mesh with the drive gear and adapted to be moved in a longitudinal direction upon the rotation of the drive gear;

an extensible/retractable antenna element driven by the drive rope to allow it to be extended or retracted;

stopper means for mechanically stopping an extending or a retracting motion of the antenna element when the antenna element reaches an extension or a retraction limit;

a shock absorber made up principally of an elastic member for alleviating an impact force by which the antenna element is stopped upon collision with the stopper means, the elastic member being placed partway on a movable system from the output shaft of the motor to impact portions colliding with the stopper means; and switching means provided in the control circuit and adapted to cut off the power supply to the motor when an elastic deformation of the shock absorber is stopped.

The aforementioned means has the following functions.

According to the present invention, a rotational force on the motor side is transmitted to the antenna side through a shock absorber made up principally of an elastic member present partway on a movable system leading to the impact portions from the motor output shaft. Upon the extension or retraction motion of the antenna element, the transmission of a drive force from the motor side to the antenna side is accomplished with the elastic member somewhat compressed, ensuring an extension or retraction motion of the antenna element. As a result, a drive force on the motor side can be stably transmitted to the antenna side over an extended period of time. Upon the completion of the antenna element's extension or retraction motion, on the other hand, the mechanism of a drive system leading to the motor side from the shock absorber is stopped after the elastic member of the shock absorber has been somewhat further compressed by an inertial moment. This action absorbs the inertial moment on the driving side including the motor and hence alleviates an impact involved upon the stopping of the action. Further, an abrupt increase in the load involved can be alleviated on the motor side. Upon the stopping of an elastic deformation of the elastic member of the shock absorber, the motor's power supply is interrupted. Therefore, the present invention detects a final sharp rise of the lead current as motion stop information and uses it as a power supply interruption instruction so that it is possible to stably and properly interrupt the power supply to the motor. Since the present invention obviates the need to provide any clutch plates which would be required on the conventional apparatus, there is no slip involved between the clutch plates and hence no loud clutch noise resulting from such a slip. Since the present invention uses a multi-threaded worm, a greater lead can be imparted to the thread. Therefore the motor can be rotated from the worm wheel through the worm. At the time when the motor is stopped, the antenna element can be manually extended or retracted, imparting an added operability to the antenna element.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
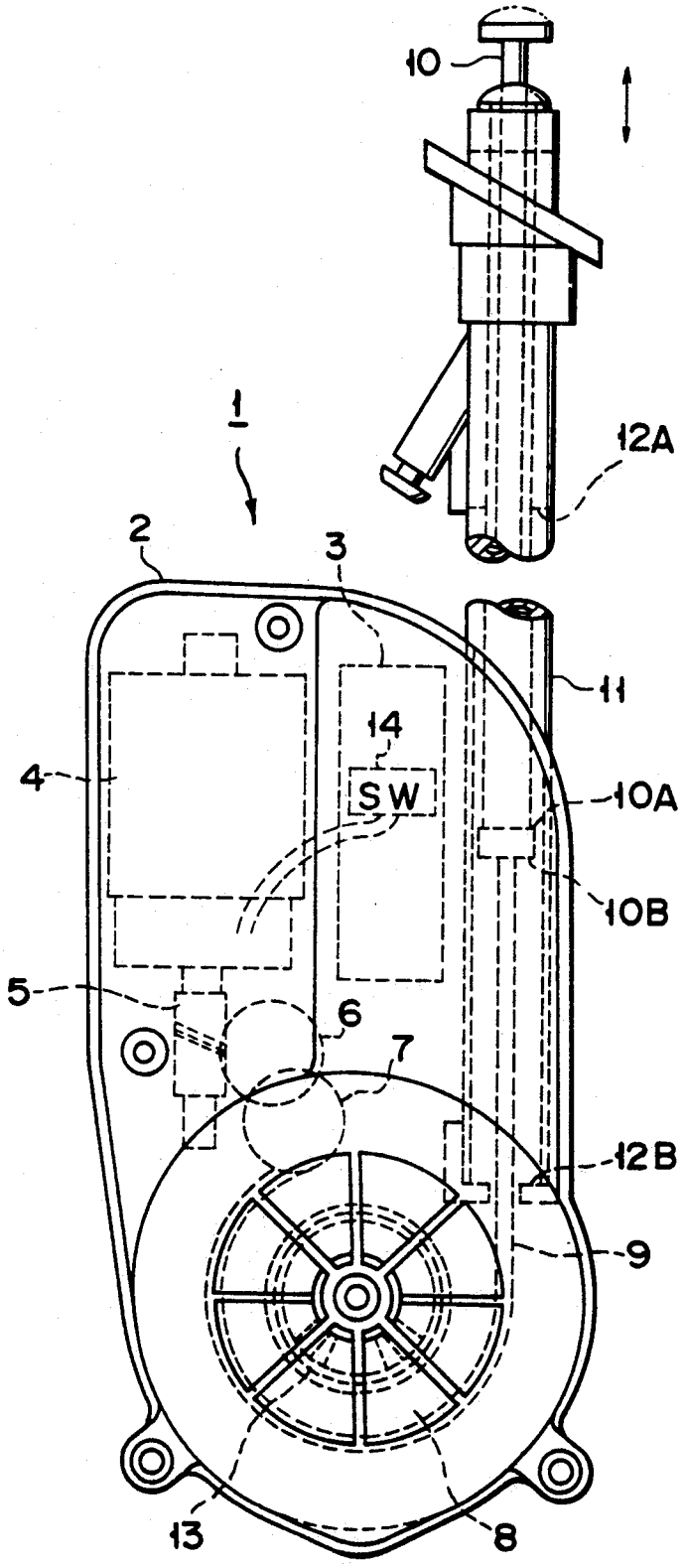
FIG. 1 is a front view generally showing an arrangement of one embodiment of the present invention.

As shown in FIG. 1, an electrically-driven type extensible/retractable antenna drive control apparatus comprises a control circuit 3 incorporated in a casing 2 of an apparatus body 1 and connected to a power supply, not shown; a motor 4 reversibly controlled by the control circuit 3; a multi-threaded worm 5 provided on an output shaft of the motor 4; a worm wheel 6 engaging with the worm 5; a drive gear 8 to which the rotational force of the worm wheel 6 is transmitted through a relay gear 7; a drive rope 9 moved in its longitudinal direction in accordance with the rotation of the drive gear 8 and made of, for example, a rigid synthetic resin; and a telescoping-type extensible/retractable antenna element 10 driven by the drive rope 9 in an extensible/-retractable fashion.

In order to mechanically stop the extension or retraction of the antenna element 10 when it reaches its extension or its retraction limit, first and second stoppers 12A and 12B are provided, the first stopper 12A being provided in an antenna storage cylinder 11 relative to the casing 2 and the second stopper 12B being provided in the casing 2 at a location where the base end of the storage cylinder 11 is mounted.

In order to alleviate an impact force when the antenna element impact portion 10A or 10B is abutted against the stopper 12A or 12B and stopped, a shock absorber 13 and switching means 14 are provided in the present embodiment. The shock absorber 13 is provided partway on a route from the motor's output shaft to the impact portion 10A or 10B and made up principally of an elastic member. The switching means 14 are arranged in the control circuit 3 so that, when the shock absorber 13 stops its elastic deformation, the supply of electric power to the motor may be interrupted.

The shock absorber 13 of the present invention includes a movable type variation restriction stopper, not shown in FIG. 1, which is of such a type that, when an amount of elastic deformation of the elastic member reaches a preset value, any further deformation is mechanically prevented.

Figure 2:
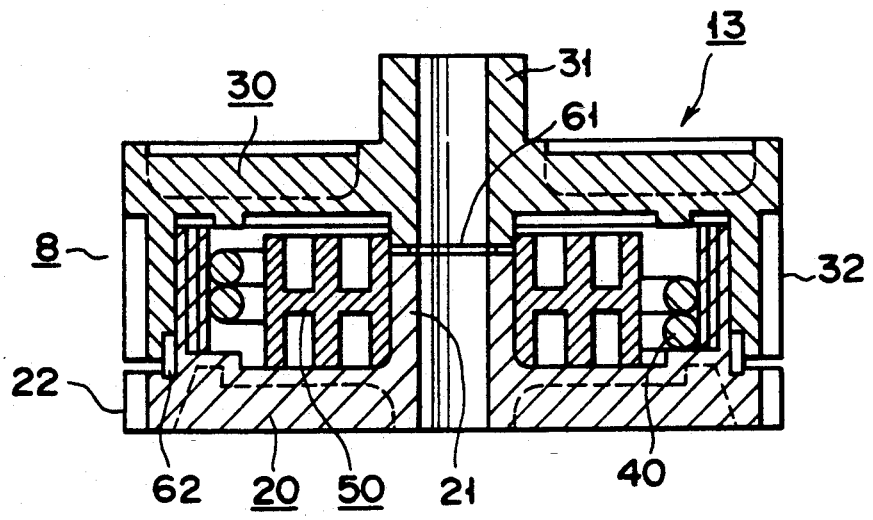
FIG. 2 is a cross-sectional view showing an arrangement of a shock absorber in the embodiment shown in FIG. 1;.
Figure 3:
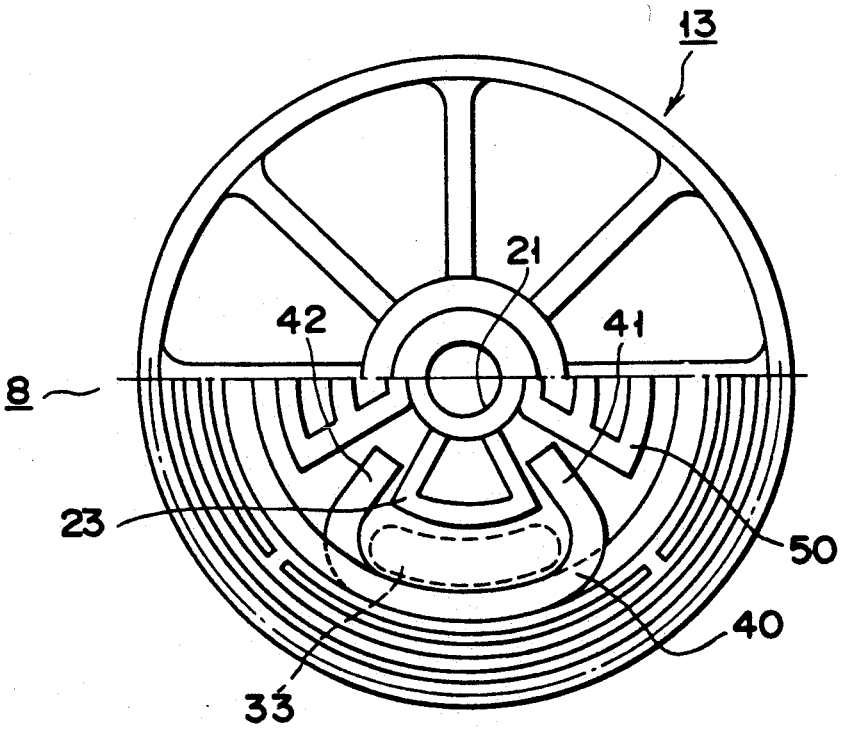
FIG. 3 is a front view, partly in cross-section, showing the arrangement of the shock absorber shown in FIG. 2.
Figure 4:
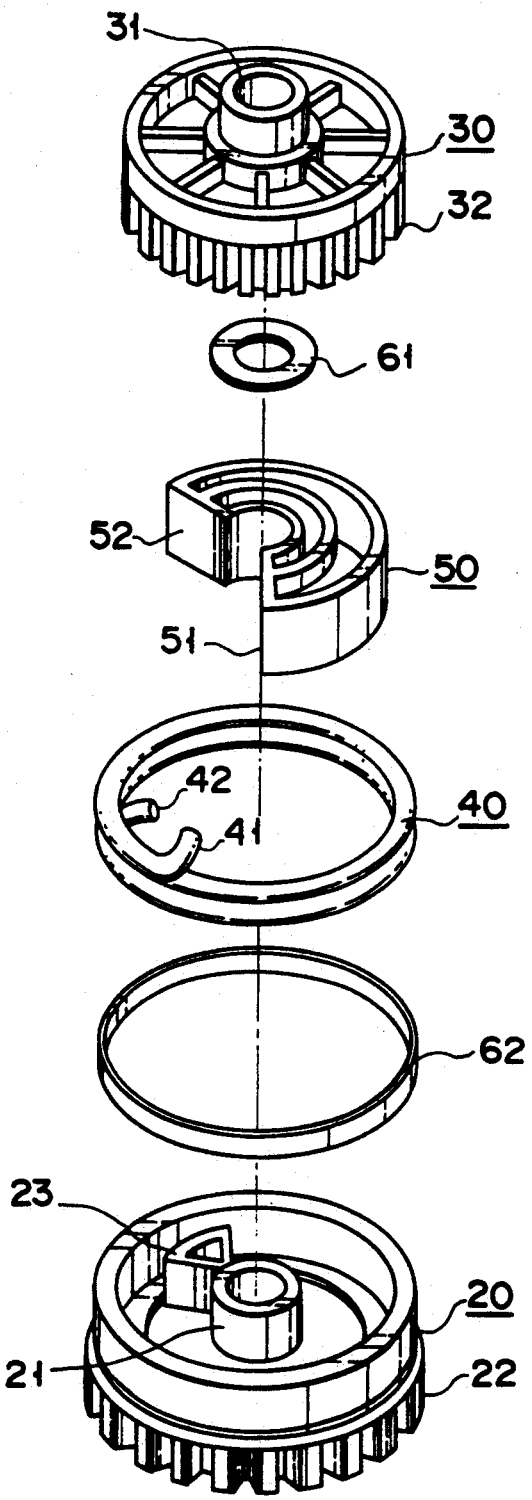
FIG. 4 is an exploded, perspective view showing the shock absorber shown in FIG. 2.

As shown in FIGS. 2 to 4, the shock absorber 13 of the present embodiment is of such a type as to be applied to, or incorporated into, the drive gear 8 which constitutes one component of a rotation mechanism. That is, the shock absorber 13 includes a disc-like substrate 20 on the driving side which is given a drive force from the motor side and a disc-like substrate 30 on the driven side which is arranged concentric with the substrate 20 to transmit a rotational force to the antenna side. The shock absorber 13 further includes a coil spring 40 disposed between these substrates 20 and 30 and engaged at one end with a projection 23 of the driving-side substrate 20 and at the other side with a projection 33 of the driven-side substrate 30 to transmit the rotational force of the substrate 20 to the substrate 30. The shock absorber 13 also includes the aforementioned displacement restriction stopper 50 (hereinafter referred to a movable stopper 50) which is rotatably provided in an annular spring insertion area present in the substrates 20 and 30 to allow an amount of elastic deformation of the coil spring 40 to be restricted to a value below the preset value.

Figure 5:
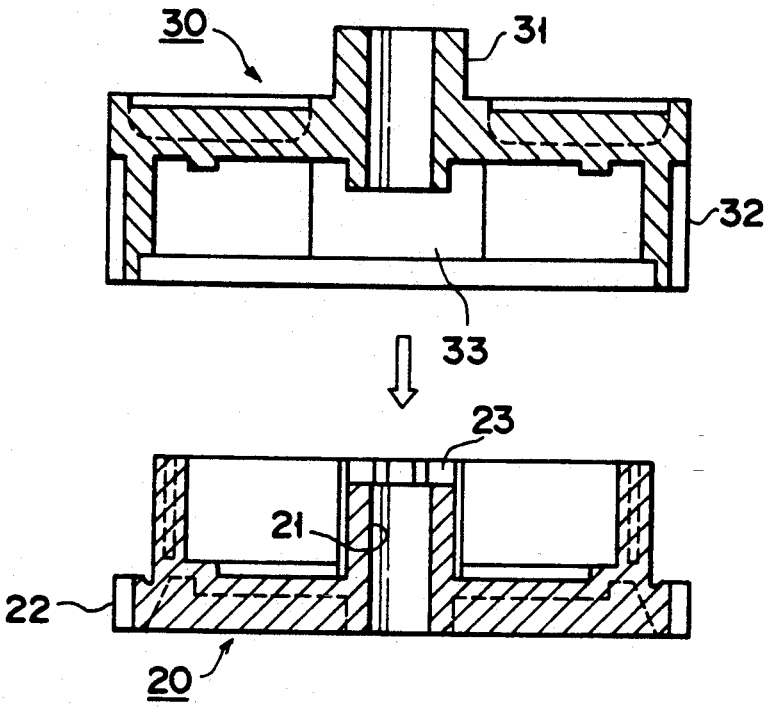
FIG. 5 is a cross-sectional view showing a driving-side substrate and a driven-side substrate of the shock absorber with these substrates shown separately.

As shown in FIG. 5, the driving-side substrate 20 is one piece molded of, for example, a rigid synthetic resin and has a cylindrical axial section 21 at its central area and a gear section 22 at its outer periphery which engages with the aforementioned relay gear 7. A projection 23 is provided on the substrate 20 at an area facing the substrate 30 and serves as a rotational force transmission element.

The projection 23 is sector-like in configuration and hollow-cylindrical as shown in FIG. 3 and engages with both the ends of the coil spring 40 as set out in more detail below.

As shown in FIG. 5, the driven-side substrate 30 is one piece molded of, for example, a rigid synthetic resin and has a cylindrical axial section 31 at its central area and a gear section 32 at its outer periphery which engages with a rack of the drive rope 9 to allow a motion of an antenna element. A projection 33 is provided on the driven-side substrate 30 at an area facing the driving-side substrate 20 and serves as a rotational force transmission element.

The projection 33 is formed, as a circular sector-like one, along a peripheral direction of the substrate 30 as indicated by a broken line in FIG. 3, and engages with both the ends of the coil spring 40.

The coil spring 40 is placed between these substrates 20 and 30 and comprised of a spiral spring of a few turns with both the end portions bent toward the center axis of the substrate, the spiral spring being made of, for example, a piano wire. Both the bent end portions of the spiral spring are located with the projections 23 and 33 of the substrates 20 and 30, respectively, sandwiched therebetween. During the extension or retraction of the antenna element, the coil spring 40 presses its one end 41 into pressure contact with the projection 23 or 33, and its other end 42 into pressure contact with the projection 33 or 23, upon the relative rotation of the projections 23 and 33 of both the substrates 20 and 30. By so doing, the rotational force of the substrate 20 is transmitted to the substrate 30. Since the shock absorber 13 has the coil spring 40 located between the substrates 20 and 30, it can be made compact as a whole.

Figure 6:
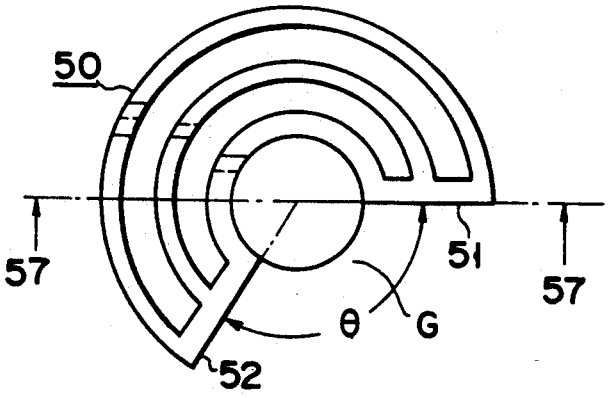
FIG. 6 is a top view showing a movable type deformation restriction stopper in the shock absorber above.
Figure 7:
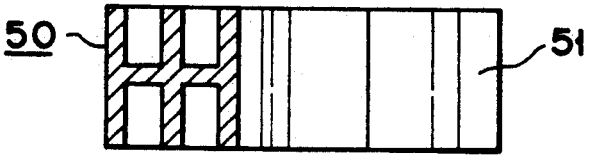
FIG. 7 is a cross-sectional view as taken along line 57—57 in FIG. 6.

The movable stopper 50 is one piece molded of, for example, a rigid synthetic resin and, is formed so that its top view has a part-circular as shown in FIG. 6 and its cross section has a lattice-shape as shown in FIG. 7. The stopper 50 has a gap G corresponding to an included angle $\theta$ of about 120° and both the end faces of the gap G provide stopper faces 51 and 52.

In FIGS. 2 and 4, reference numeral 61 shows a slidable washer interposed between the connection surfaces of the cylindrical axial section 21 of the substrate 20 and the cylindrical axial section 31 of the substrate 30; and 62, a slidable ring interposed between the facing surfaces of the outer periphery of the substrate 20 and inner periphery of the substrate 30. The slidable washer and ring as set out above perform a lubrication function.

Figure 8:
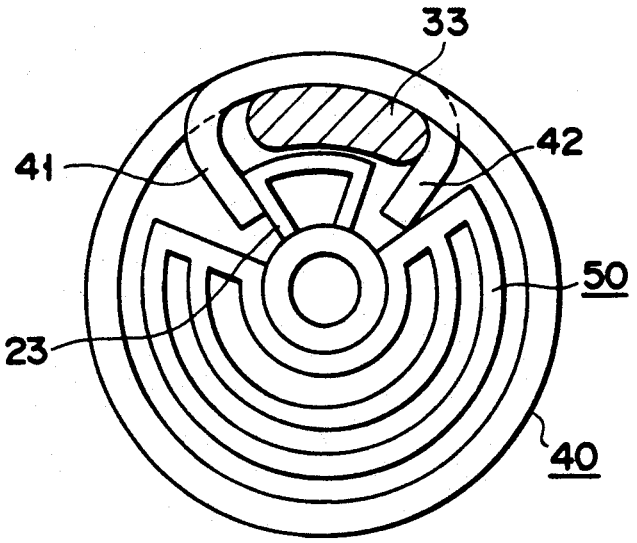
FIGS. 8 and 9 show a relation among a projection of the driving-side substrate, projection of the driven-side substrate, coil spring and movable type stopper of the shock absorber above, FIG. 8 being a view showing an extended state of an antenna element and FIG. 9 being a view showing a state in which the extension motion of the antenna element is completed.

FIG. 8 shows a state of a major area of the shock absorber 13, in the extending state of the antenna element 10. As shown in FIG. 8, one side surface (left side surface in the Figure) of the driving-side projection 23 is placed in pressure contact with the inner side surface of the bent end portion 41 of the coil spring 40, and the one end face (right end face in the Figure) of the driven-side projection 33 is placed in pressure contact with the inner side surface of the bent end other portion 42 of the coil spring 40. The angular relation of these parts are so set as shown in FIG. 8.

Figure 9:
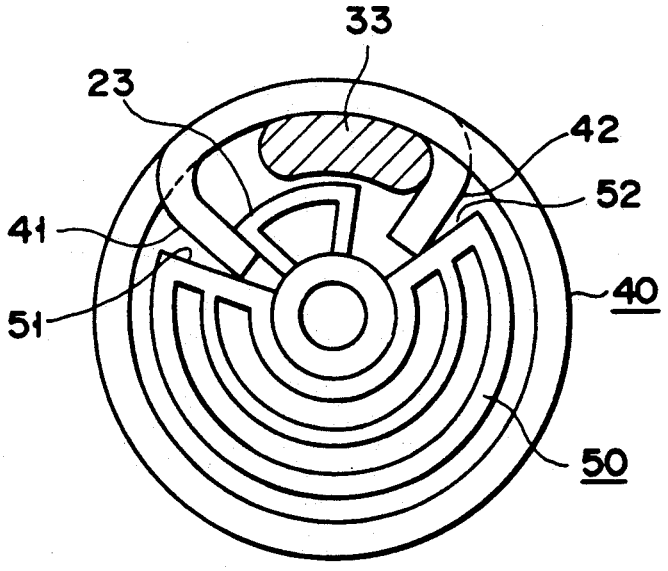

FIG. 9 shows the state of the major area of the shock absorber 13 with the extending motion of the antenna element 10 being completed and the motor power supply being interrupted. In this case, the motor 4 continues its rotation and the driving-side projection 23 tries to rotate in a direction away from the driven-side projection, that is, in the counter-clockwise direction in FIG. 9. For this reason, the coil spring 40 is compressed in an inner direction. Since, however, the ends 41 and 42 of the spring abut against stops faces 51 and 52 of the stopper 50, respectively, its elastic deformation is restricted, enhancing the life expectancy of the coil spring 40 under the elastic deformation restriction action and thus enabling use for an extended period of time.

When the antenna element 10 is retracted, the pressure contact relation of the projections 23 and 33 of the shock absorber 13 to the bent portions 41 and 42 of the coil spring 40 is so set as to be reversed in their right-/left direction (see FIGS. 8 and 9).

Figure 10A:
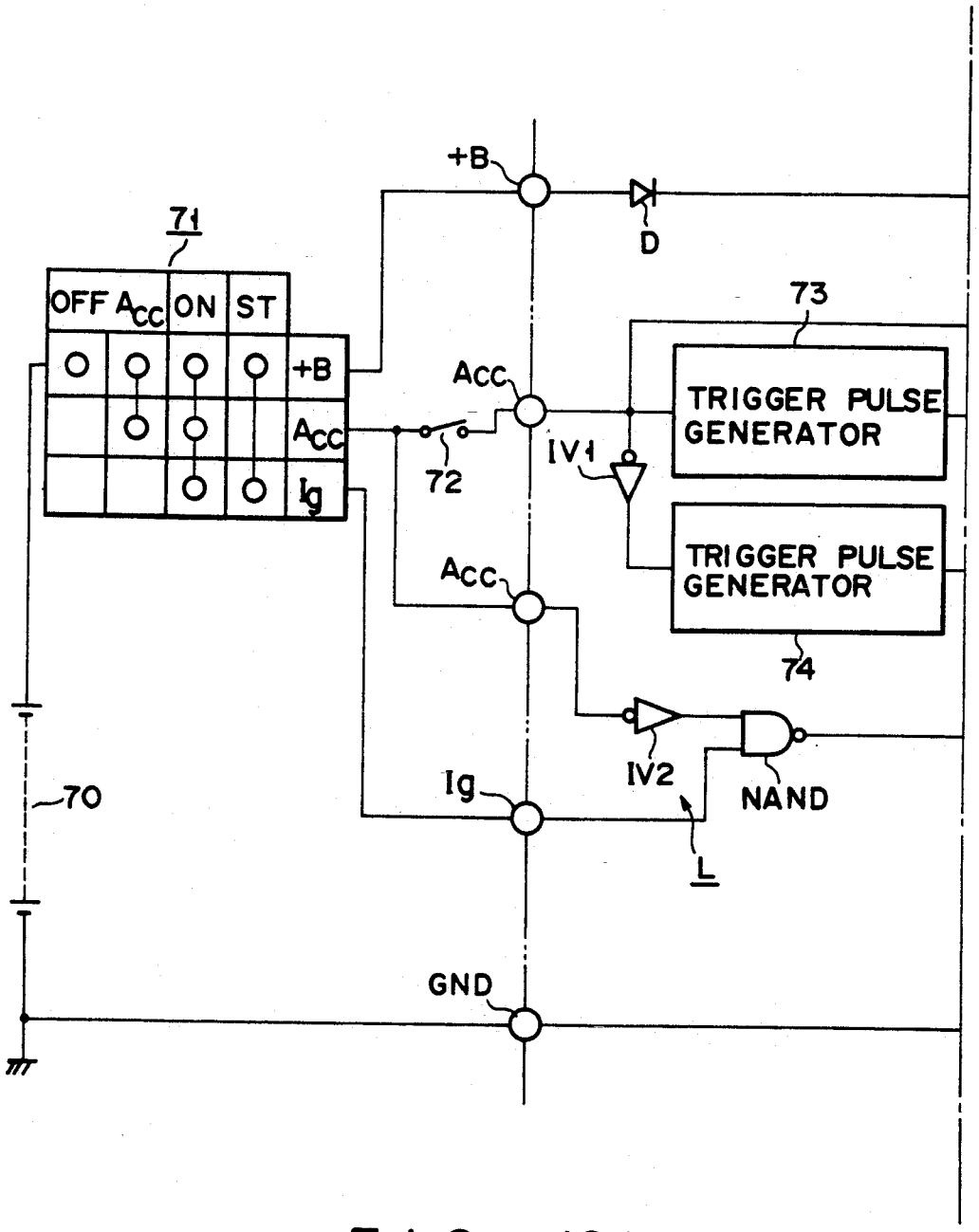
FIGS. 10A and 10B show an arrangement of a control circuit in the embodiment of the present invention.
Figure 10B:
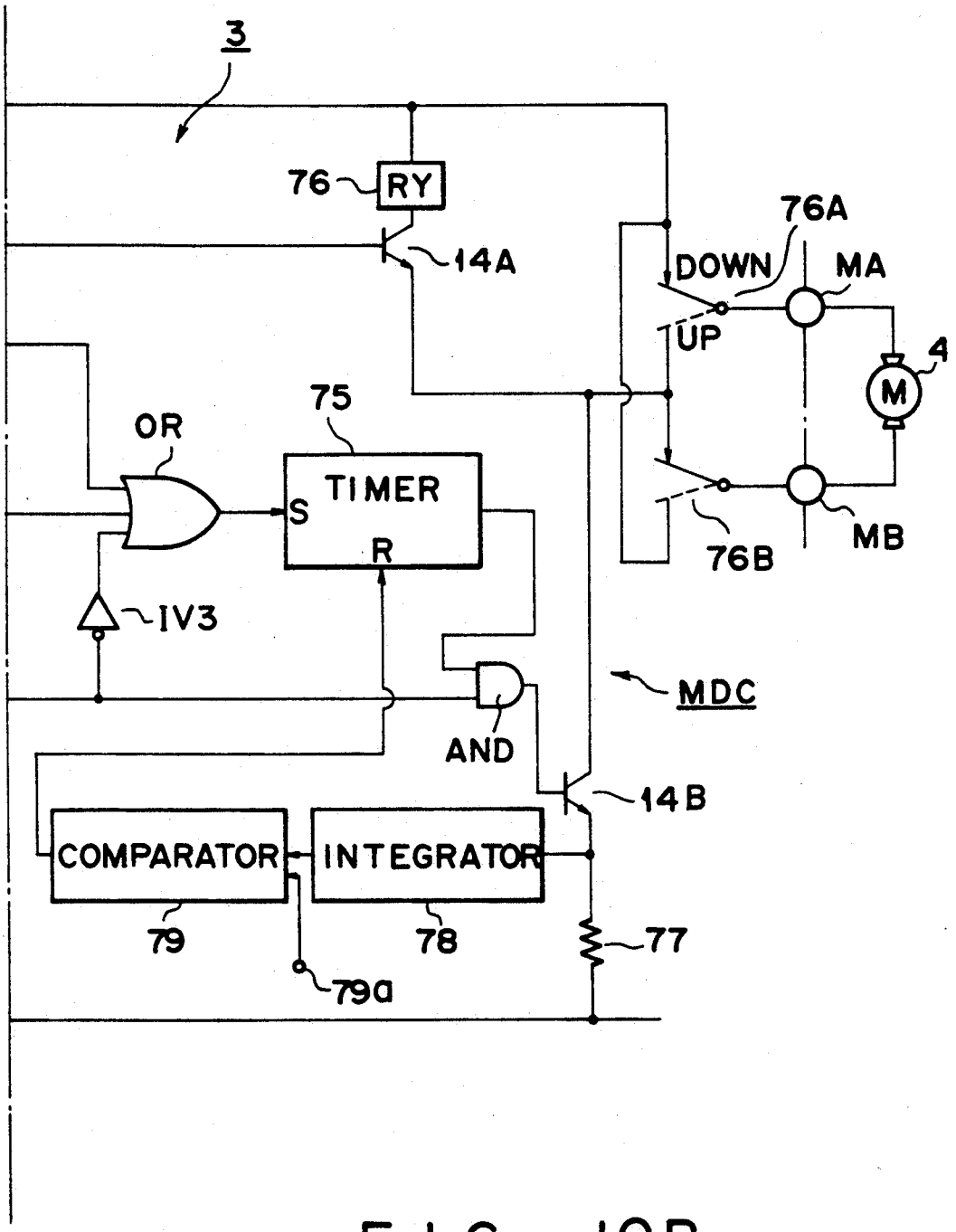

As shown in FIGS. 10A and 10B, the control circuit 3 includes a resistor 77 connected to a motor drive circuit MDC, an integrator 77 for calculating the integration value of a motor drive current flowing through the resistor 77, and a comparator 79 for comparing a past integration current value which is calculated by the integrator 78 with a preset value to see whether or not the former value exceeds the latter value. The circuit 3 as set out above is characterized in that the motor drive circuit MDC is interrupted in accordance with an output result of the comparator and that, after interrupting the current of the motor drive circuit MDC, the motor is open-circuited at both the ends and then reverse-rotated through the release of an energy stored in the drive mechanism system.

In FIGS. 10A and 10B, reference numeral 70 denotes a battery mounted on an automobile and 71, a key switch. The key switch 71 sends a +B output when the key position of the key switch 71 is OFF, sends +B and Acc outputs when the key position of the key switch is Acc, sends +B, Acc and Ig outputs when the key position of the key switch is ON and sends +B and Ig outputs when the key position of the key switch is ST. In these Figures, 72 shows a switch operated in association with the ON and OFF of, for example, a radio; 73, a trigger pulse generator triggered when the antenna is extended or moved upward; 74, a trigger pulse generator triggered when the antenna is retracted or moved downward; 75, a timer; 76, a relay; 76A and 76B, relay contacts; 77, the resistor for current detection; 78, the integrator; 79, the comparator; 79*a*, a preset-input terminal; 14A and 14B, NPN type transistors serving as a switching means 14; IV1 tq IV3, inverters; D, a diode; NAND, a NOT-AND gate; OR, an OR gate; AND, an AND gate; +B, Acc, Ig, GND, MA and MB, terminals.

The operation of the whole apparatus will be explained below, paying attention principally to the operation of the control circuit shown in FIGS. 10A and 10B.

(1) With the switch 72 ON, a high level signal is input to the trigger pulse generator 73 on the extended side of the antenna. The trigger signal of the trigger pulse generator 73 is sent through the OR gate to the set input of the timer 75. Thus the timer is placed in a set state.

(2) The ON signal of the timer 75 is supplied to one gate input of the AND gate. The other input of the AND gate receives a signal which becomes a low level only when the key switch 71 is placed in the ST position. The output of the AND gate goes high to turn the transistor 14B ON.

(3) At the same time, the switch 72 is turned ON and the transistor 14A is turned ON, causing the relay 76 to be energized to allow the relay contacts 76A and 76B to be switched to an UP side as indicated by broken lines in FIG. 10B.

(4) As a result, a closed circuit is created on a route from +B past D, UP of 76B, 4, UP of 76A, 14B and 77 to GND to enable the motor 4 to be rotated toward raising the antenna element so that the antenna element 10 is extended.

(5) When the antenna element 10 reaches a top dead center (extension limit), the rotation energy of the motor 4 is once absorbed by the coil spring 40 in the shock absorber 13 and then stored in the rope 9. When this occurs, the rotation of the motor 4 is slowed down, allowing a current in the motor to be increased. The current is converted by the resistor 77 to a voltage. The voltage is supplied to the integrator 78 where it is integrated for a predetermined period of time. An abrupt change in the current is averaged through integration. It is thus possible to prevent an operation error of the circuit resulting from, for example, an abrupt current variation caused upon the extending motion of the antenna element. In the comparator 79, the output voltage of the integrator is compared with the preset value by which the current in the motor 4 has a proper correlation to an "extending" force of the antenna element.

When the integration value exceeds the preset value, the timer is reset.

(6) Upon the resetting of the timer 75, the AND gate is disabled, causing the transistor 14B and hence the transistor 14A to be turned OFF.

(7) When the antenna element 10 does not reach the top dead center (extension limit) for some reason or other, the integration value does not reach the preset value and the timer 75 is turned OFF in a predetermined period of time, causing the motor to be stopped.

(8) When the switch 72 is switched from an ON to an OFF state, a high level signal is supplied to the "retracting" side trigger pulse generator 74 through the inverter IV1, turning the timer 75 ON as in the case of the "extending (upward)" motion of the antenna element.

(9) The transistor 14B is turned ON as in the case of the "extending" motion of the antenna element. However, since, at this time, the transistor 14A is turned OFF, the relay 76 is not energized and its relay contacts 76A and 76B remain unswitched. Thus a closed circuit is established on a route from +B past DOWN of 76A, 4, DOWN of 76B, 14B and 77 to GND. As a result, the motor 4 is rotated in the "retracting" direction, lowering the antenna element 10 for retraction.

The subsequent operation is the same as that in the case of the "extending" motion of the antenna.

(10) With the engine key in the starter ST position during the "extension" or "retraction" mode, an Acc signal is turned OFF and Ig signal is turned ON, respectively. Through a logic circuit L comprised of the inverter IV2 and NAND gate, the AND gate is turned OFF and hence the transistor 14B is turned OFF, interrupting the motor drive circuit MDC and stopping the motor 4. The reason is that, upon the operation of the starter ST during the motion of the antenna element 10, the up/down motion of the antenna element 10 is caused to stop to make an energy dissipation at the antenna side of the battery 70 as small as possible.

The aforementioned control circuit 3 can be made compact because the motor drive circuit MDC is comprised of the switching means 14 made of a semiconductor. Further, since the motor is open-circuited at its ends upon the interruption of a power supply to the motor, it is easy to rotate the motor 4, for example, manually from the worm wheel 6 side. An increase in the current of the motor is detected as a practical value corresponding to a past performance value through the use of the integration element, whereby when the practical value exceeds the preset value the current in the motor is interrupted. Therefore, there is no possibility that the motor will be stopped by an operation error originating in a disturbance such as a variation in a power supply level.

Figure 11:
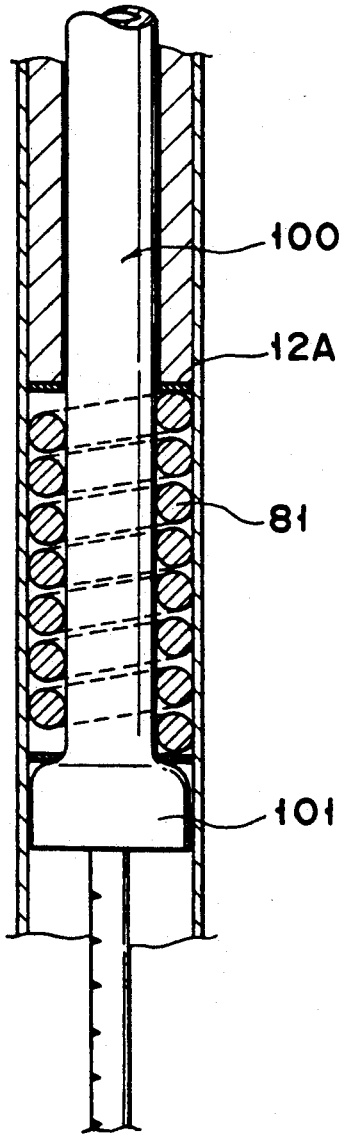
FIGS. 11 and 12 are views showing a variant of the shock absorber above.
Figure 12:
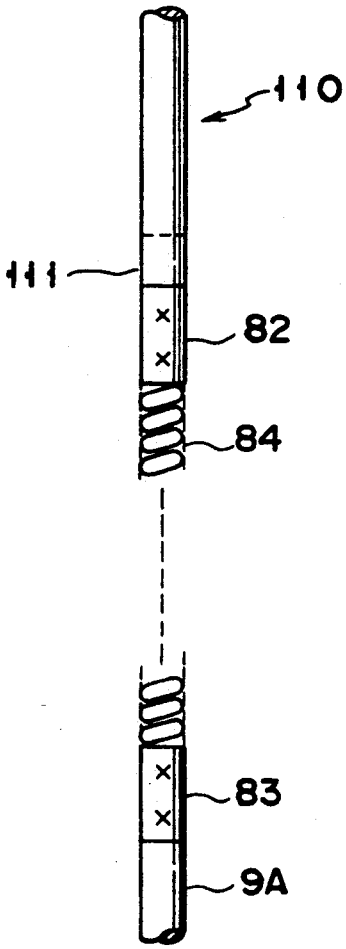

As the shock absorber 13, use may be made of a coil spring 81 interposed between the first stopper 12A and an enlarged base end 101 of the antenna element 100 as shown in FIG. 11. Use is also made of a coil spring 84 interposed between a forward end 9A of the rope 9 and a reduced-diameter base end 111 of the antenna element 110 with a pair of joints 82, 83 provided one at the base end 111 side of the antenna element and one at the forward end 9A side of the rope 9 as shown in FIG. 12.

Although, in the aforementioned embodiment, the movable stopper 50 has been explained as the deformation restriction stopper for the coil spring 40, a fixed stopper may be used which is formed integral with the driven-side substrate 30.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A drive control apparatus for an electrically-driven extendible and retractable antenna, comprising:

a control circuit connected to a power supply;

a motor, controllable by the control circuit, rotatable in a first direction and a second direction opposite to said first direction;

a multi-threaded type worm gear provided on an output shaft of the motor;

a worm wheel for engaging the worm gear;

a drive gear for receiving a rotational force from the worm wheel and being rotatably driven by the rotational force from the worm wheel;

a drive rope having a rack in mesh with the drive gear and adapted to be moved in a longitudinal direction upon rotation of the drive gear;

an extendable and retractable antenna element driven by the drive rope for extending and retracting the antenna element;

stopper means for mechanically stopping an extending motion and a retracting motion of the antenna element when the extendible and retractable antenna element reaches one of an extension and a retraction limit;

shock absorber means, comprising an elastic member, for absorbing an impact force generated when the extendible and retractable antenna element collides with the stopper means, the elastic member being positioned on a movable system extending from the output shaft of the motor to a plurality of colliding impact portions that collide with the stopper means;

switching means provided in the control circuit and adapted to cut off the power supply to the motor when an elastic deformation of the shock absorber is stopped;

said shock absorber means further comprising:

a first disk-like substrate positioned on a first side of the shock absorber means, said shock absorber means being coupled to a rotation mechanism connecting the drive gear and the worm wheel, said first disk-like substrate being rotated when a drive force is received from the motor;

a second disk-like substrate positioned on a second side of said shock absorber means, concentric with and opposite to the first disk-like substrate, for transmitting a received rotational force from the first disk-like substrate to an antenna side of said shock absorber means;

a coil spring positioned concentrically between the first disk-like substrate and the second disk-like substrate, a first end of the coil spring engaging a portion of the first disk-like substrate , and a second end of said coil spring engaging a portion of said second disk-like substrate, said coil spring transmitting a rotational force of the first disk-like substrate to the second disk-like substrate; and said stopper means including a movable type elastic deformation restricting stopper for restricting an amount of elastic deformation of said coil spring to a value that is below a preset value, said movable type elastic deformation restricting stopper being rotatably positioned in an annular spring insertion area provided between the first disk-like substrate and the second disk-like substrate, said movable type elastic deformation restricting stopper mechanically restricting the deformation of the coil spring whenever the amount of the elastic deformation of the coil spring reaches the preset value.

2. The drive control apparatus according to claim 1, wherein said control circuit comprises:

an electrical resistor included in a motor drive circuit;

an integrator provided for integrating a motor drive current flowing in the electrical resistor; and a comparator for comparing the integrated value of the motor drive current with a predetermined value and for determining whether the integrated value exceeds the predetermined value; and means for interrupting the motor drive circuit responsive to an output of the comparator to cut off prior supply to the motor.

3. The drive control apparatus according to claim 1, wherein when a current in the motor drive circuit has been interrupted, the control circuit opens a circuit at a first and a second end portion of the motor to enable the motor to be reverse-rotated through a release of an energy source stored in a drive mechanism system.

4. The drive control apparatus according to claim 1, wherein said control circuit is provided in a casing of an apparatus body.

* * * * *